US006568467B1

(12) United States Patent
Ohira et al.

(10) Patent No.: US 6,568,467 B1
(45) Date of Patent: May 27, 2003

(54) HELICAL TYPE HEAT EXCHANGER HAVING INTERMEDIATE HEATING MEDIUM

(75) Inventors: Hiroaki Ohira, Higashi-Ibaraki-gun (JP); Kuniaki Ara, Higashi-Ibaraki-gun (JP)

(73) Assignee: Japan Nuclear Cycle Development Institute, Ibaraki-ken (JP)

( * ) Notice: Subject to any disclaimer, the term of this patent is extended or adjusted under 35 U.S.C. 154(b) by 0 days.

(21) Appl. No.: 10/118,241

(22) Filed: Apr. 9, 2002

(30) Foreign Application Priority Data

Nov. 16, 2001 (JP) ..... 2001-351371

(51) Int. Cl.[7] ..... F28D 7/10; F28D 7/12

(52) U.S. Cl. ..... 165/163; 165/141; 165/156; 165/140

(58) Field of Search ..... 165/140, 141, 165/163, 154, 157, 156, 159, DIG. 8

(56) References Cited

U.S. PATENT DOCUMENTS 4,090,554 A * 5/1978 Dickinson ..... 165/70
4,096,616 A * 6/1978 Coffinberry ..... 165/154
4,479,533 A * 10/1984 Persson et al. ..... 165/140
4,625,789 A * 12/1986 Chaix et al. ..... 165/159
5,048,597 A * 9/1991 Bond ..... 165/141
6,047,767 A * 4/2000 Bodhaine et al. ..... 165/141
6,095,240 A * 8/2000 Hassanein et al. ..... 165/141

FOREIGN PATENT DOCUMENTS

JP 53-131394 11/1978

* cited by examiner

*Primary Examiner*—Henry Bennett
*Assistant Examiner*—Tho V Duong
(74) *Attorney, Agent, or Firm*—Wenderoth, Lind & Ponack, L.L.P.

(57) ABSTRACT

A heat exchanger having an intermediate heating medium has a shell of the heat exchanger, a plurality of cylindrical partition tubes each of which has an annular space therein and is closed at both end portions thereof with annular walls, the cylindrical partition tubes being arranged concentrically in a mutually spaced manner in the shell, and helical coil-shaped heat exchanger tubes each of which is disposed in the annular space in the cylindrical partition tube. A high-temperature heating medium flows in the shell through clearances among the helically arranged multiple cylindrical partition tubes, a low-temperature heating medium flows in each of the helical coil-shaped heat exchanger tubes, and an intermediate heating medium chemically inactive with respect to both the high-temperature heating medium and the low-temperature heating medium and excellent in the heat transferring performance is passed through each of the annular spaces in the cylindrical partition tubes.

11 Claims, 2 Drawing Sheets

HELICAL TYPE HEAT EXCHANGER HAVING INTERMEDIATE HEATING MEDIUM

BACKGROUND OF THE INVENTION

This invention relates to a heat exchanger capable of being effectively used for heat exchange of a liquid metal-water system conducted in, for example, a liquid metal-cooled reactor in which a high-temperature heating medium and a low-temperature heating medium are not allowed to contact each other, and more particularly to a heat exchanger adapted to conduct heat exchange via an intermediate heating medium chemically inactive with respect to both the high-temperature heating medium and low-temperature heating medium.

In a liquid-metal cooled reactor using, for example, liquid sodium as a coolant, heat exchange is carried out between a sodium system in which high-temperature sodium is circulated and a water-vapor system. In such a heat exchanger, when the sodium and water contact each other due to damage to a heat exchanger tube, both the sodium and water react with each other violently to get into the danger of causing a disaster to occur.

As a means for preventing the sodium and water from immediately contacting each other even when damage to a heat exchanger tube occurs, a method of conducting heat exchange via a stable substance, which reacts with neither the sodium nor water, is proposed in, for example, Japanese Patent Laid-Open No. 53-131394A/1978.

In a heat exchanger concretely proposed in the above-described prior art, a heat exchanger tube is molded in the form of a double tube structure having an outer tube and an inner tube, and water (low-temperature heating medium) is passed through the inner tube with sodium (high-temperature medium) passed through a space on the outer side of an outer circumference of the outer tube. An annular portion between the inner tube and the outer tube is filled with a stable substance (intermediate heating medium) reacting with neither water nor sodium, for example, mercury, via which heat exchange is conducted.

According to the prior art heat exchanger described above, it has the effect of preventing, owing to the presence of the intermediate heating medium, the sodium and water from contacting each other immediately even when one of the outer tube and the inner tube of the doubly formed heat exchanger tube is damaged. However, since a clearance between the inner tube and the outer tube in the double tube structure is comparatively narrow, the possibility that the inner tube and the outer tube can be damaged simultaneously is large. Furthermore, since the quantity of the intermediate heating medium flowing through the annular clearance is small, the possibility that the double tube structure is damaged, causing the sodium and water to contact each other, cannot necessarily be eliminated sufficiently.

Moreover, since all the heat exchanger tubes are formed as double tube structures, the construction of the heat exchanger becomes complicated, and the manufacturing cost becomes high.

SUMMARY OF THE INVENTION

An object of the present invention is therefore to provide a heat exchanger having an intermediate heating medium, capable of reducing more greatly the possibility that sodium and water contact each other directly than the above-described prior art heat exchanger in which an outer tube and an inner tube are formed to a double tube structure with a clearance between the outer tube and the inner tube filled with an intermediate heating medium, having a simple heat exchanger tube structure as compared with the double tube structure, and capable of reducing the manufacturing cost.

The heat exchanger having an intermediate heating medium according to the present invention comprises a shell of the heat exchanger, a plurality of cylindrical partition tubes each of which has an annular space therein and is closed at both end portions thereof with annular walls, the cylindrical partition tubes being arranged concentrically in a mutually spaced manner in the shell, and helical coil-shaped heat exchanger tubes each of which is disposed in the annular space in the cylindrical partition tube. A high-temperature heating medium flows in the shell through clearances among the helically arranged multiple cylindrical partition tubes, a low-temperature heating medium flows in each of the helical coil-shaped heat exchanger tubes, and an intermediate heating medium chemically inactive with respect to both the high-temperature heating medium and the low-temperature heating medium and excellent in heat transferring performance is passed through each of the annular spaces in the cylindrical partition tubes.

According to the heat exchanger of the present invention having such a structure, the helical coil-shaped heat exchanger tube is disposed in each of the multiple cylindrical partition tubes having the annular space therein. Therefore, this heat exchanger is structurally simple and can reduce the manufacturing cost as compared with the prior art heat exchanger in which all of the heat exchanger tubes are formed into double tube structures each of which includes an outer tube and an inner tube.

Further, since it is not unnecessary that a clearance between the inner surface of the cylindrical partition tube and the helical coil-shaped heat exchanger tube be formed as narrowly as that between the outer tube and the inner tube of the prior art double tube structure, the interior of the cylindrical partition tube can be filled with a large quantity of intermediate heating medium. Therefore, the possibility that the high-temperature heating medium (for example, sodium) in the exterior of the cylindrical partition tubes and the low-temperature heating medium (for example, water) in the interior of the heat exchanger tubes contact each other can be reduced to an extremely low level even when any heat exchanger tube or cylindrical partition tube should be damaged.

Furthermore, since the intermediate heating medium having an excellent heat transferring performance is not only packed, but also constantly circulated in a fluidized state in the interior of the cylindrical partition tubes, the performance of transferring heat from the high-temperature heating medium to the low-temperature heating medium is not substantially spoiled.

In a preferred embodiment of the present invention, opposed inner surfaces of each of the cylindrical partition tubes are provided with a plurality of baffle plates so that the baffle plates on the opposed inner surface project alternately among the helical coil-shaped heat exchanger tubes. Owing to this arrangement, the intermediate heating medium flowing in the cylindrical partition tubes can be made to flow in a zigzag pattern. As a result, the effectiveness of the heat exchange between the high-temperature heating medium in the exterior of the cylindrical partition tubes and the low-temperature heating medium in the interior of the heat exchanger tubes conducted via the intermediate heating medium is further improved, and the heat transferring performance of the heating media can be improved.

In a more preferred embodiment of the present invention, spiral spacers are disposed in the clearances among the concentrically arranged multiple cylindrical partition tubes. Owing to this arrangement, a flow passage for the high-temperature heating medium between the multiple cylindrical partition tubes can be secured. As a result, the heat exchange between the high-temperature medium in the exterior of the cylindrical partition tubes and the intermediate heating medium in the interior thereof is carried out effectively, and the heat transferring performance of the heating media can be improved.

PREFERRED EMBODIMENTS OF THE INVENTION

Figure 1:
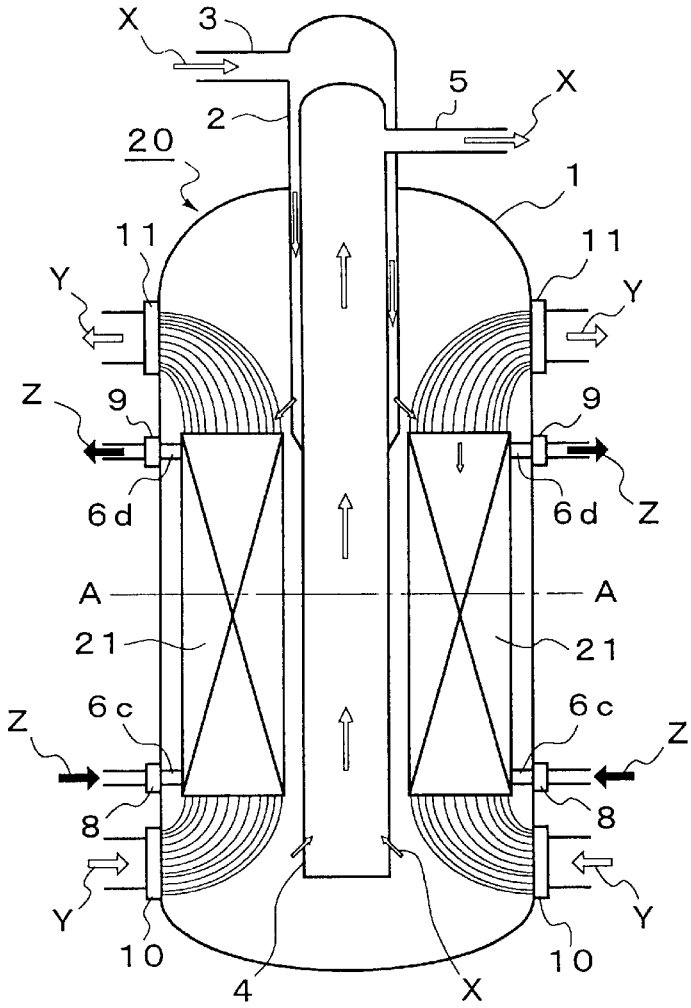
FIG. 1 is a longitudinal sectional view showing the concept of an embodiment of the helical type heat exchanger according to the present invention.
Figure 2:
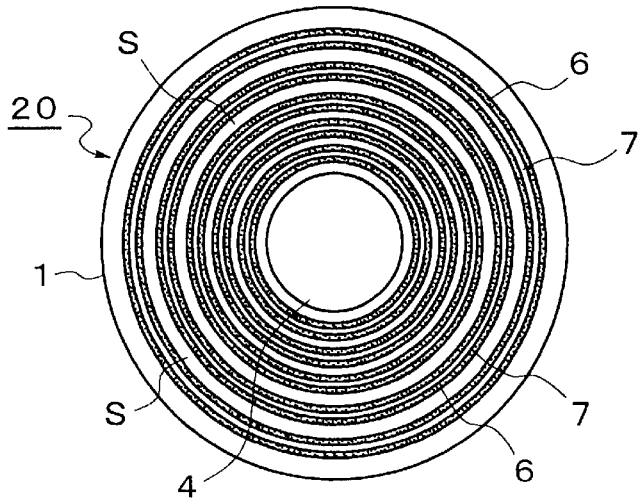
FIG. 2 is a horizontal sectional view of a tube bundle taken along the line A—A in FIG. 1.

FIG. 1 is a longitudinal sectional view showing the concept of an embodiment of the helical type heat exchanger 20 according to the present invention, and FIG. 2 is a horizontal sectional view of a tube bundle taken along the line A—A in FIG. 1. In a shell 1 of the heat exchanger 20 of FIG. 1, there is positioned a tube bundle 21 comprising a plurality of cylindrical partition tubes which will be described hereinbelow, and a helical coil-shaped heat exchanger tube disposed in each cylindrical partition tube. At a top portion of the shell 1 of the heat exchanger 20, an inlet pipe 2 for a high-temperature heating medium X (for example, liquid sodium) is passed therethrough and extends to the interior of the shell 1. The high-temperature heating medium X entering a high-temperature heating medium inlet 3 flows through this inlet pipe 2, and is guided to the interior of the shell 1. While the high-temperature heating medium flows from the upper portion of the tube bundle 21 toward the lower portion thereof, heat exchange is conducted. Thereafter, the high-temperature heating medium flows into a high-temperature medium outlet pipe 4 opened below the tube bundle 21, and is then guided upward and flowing out from a high-temperature heating medium outlet 5.

Figure 3:
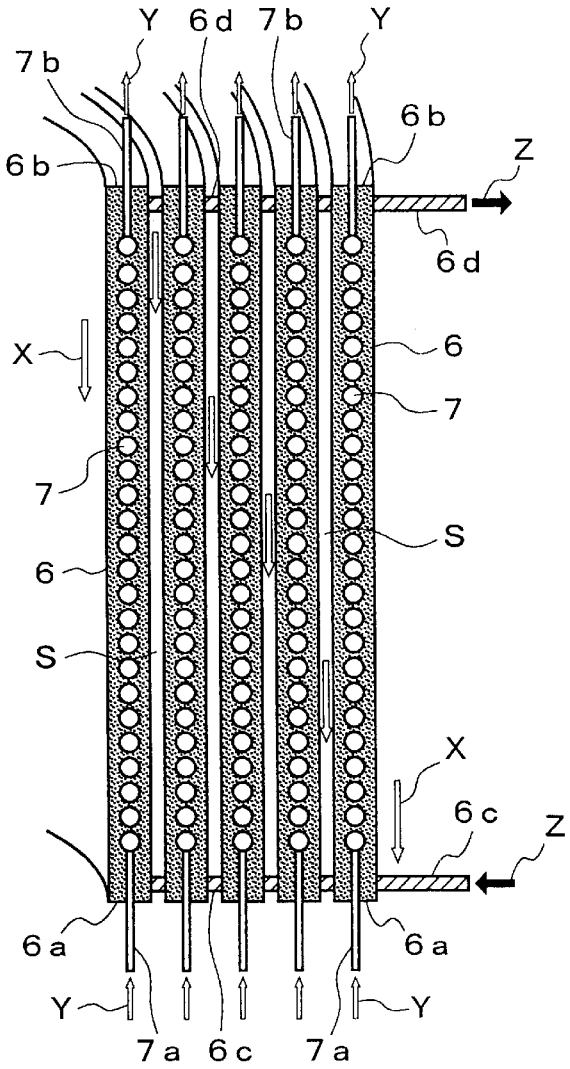
FIG. 3 is a longitudinal sectional view of the tube bundle of FIG. 1.

The construction of the tube bundle 21 is illustrated in detail in FIG. 2, a cross-sectional view thereof, and FIG. 3, a longitudinal sectional view. Namely, as is understood from FIGS. 2 and 3, the tube bundle 21 is formed by arranging a plurality of cylindrical partition tubes 6, each of which has an annular space therein, in a multiplex and concentric manner so that the multiple cylindrical partition tubes 6 are spaced from each other by a distance S, and disposing a heat exchange tube 7 wound in the shape of a helical coil within the annular space in each cylindrical partition tube 6.

A bottom end portion and a top end portion of each of the cylindrical partition tubes 6 are closed with annular walls 6*a*, 6*b* to form the annular space, and these multiple cylindrical partition tubes 6 are communicated with and connected to one another at the vicinity of the annular walls at both end portions thereof by a lower connecting tube 6*c* and an upper connecting tube 6*d*. End portions of each of the connecting tubes 6*c*, 6*d* are guided to the outside of the shell 1 of the heat exchanger 20 as shown in FIG. 1, and the end portion of the lower connecting tube 6*c* forms an inlet 8 for the intermediate heating medium Y, and the end portion of the upper connecting tube 6*d* an outlet 9 for the intermediate heating medium Y, respectively.

The helical coil-shaped heat exchange tube 7 disposed in each cylindrical partition tube 6 passes at its lower end portion 7*a* through the bottom annular wall 6*a* of the cylindrical partition tube, and extends to the interior of the heat exchanger shell 1; and passes at its upper end portion 7*b* through the top annular wall 6*b* of the cylindrical partition tube, and extends to the interior of the heat exchanger shell 1. In the illustrated embodiment, the lower end portions 7*a* and the upper end portions 7*b* of the heat exchanger tubes 7 passed through the partition tube annular walls 6*a*, 6*b* are collected and constitute thick tube bundles within the heat exchanger shell 1 as shown in FIG. 1. Each of the collected tube bundles is covered with, for example, a thick tube (not shown) having a resistance to breakage and guided to the outside of the shell 1 to form a low-temperature heating medium inlet 10 and a low-temperature heating medium outlet 11.

In the embodiment shown in FIG. 1, the intermediate heating medium inlets 8 and outlets 9 and the low-temperature heating medium inlets 10 and outlets 11 are provided at left and right portions of the heat exchanger shell 1. This indicates a structure having heating medium outlets and inlets at two portions of a circumference of each cylindrical partition tube 6 and each helical coil-shaped heat exchanger tube 7. By providing plural outlets and inlets for the intermediate heating medium Z and the low-temperature heating medium Y at the plural circumferential portions, a fluid resistance of the heating media becomes low, and the heat transferring performance thereof can be improved. The number of the portions of the shell which are circumferentially spaced from each other and which are provided with heating medium outlets and inlets, is not limited to two as shown in the embodiment of FIG. 1. Such outlets and inlets can also be provided at not less than three portions of the shell.

In the helical type heat exchanger 20 of such a construction, the high-temperature heating medium X flowing from the high-temperature heating medium inlet 3 into the interior of the heat exchanger shell 1 through the inlet pipe 2 flows down through the clearances S among the concentrically arranged multiple cylindrical partition tubes 6. This high-temperature heating medium thereafter flows into the high-temperature medium outlet pipe 4, and is guided upward to flow out from the high-temperature heating medium outlet 5. The low-temperature heating medium Y (for example, water) flowing from the low-temperature heating medium inlets 10 into each helical coil-shaped heat exchanger tube 7 rises up as it flows helically therein, and flows out in the form of vapor from the low-temperature heating medium outlets 11. The intermediate heating medium Z flowing from the intermediate heating medium inlets 8 passes through the lower connecting tubes 6*c*, and is guided to a lower portion of each cylindrical partition tube 6. This intermediate heating medium rises up in each cylindrical partition tube 6, and thereafter flows out from the intermediate heating medium outlets 9 via the upper connecting tubes 6*d*. Thus, the high-temperature heating medium X flowing in the exterior of the cylindrical partition tubes 6 and the low-temperature heating medium Y flowing in the heat exchanger tubes 7 are subjected to heat exchange via the intermediate heating medium Z flowing in the cylindrical partition tubes 6.

A liquid metal chemically inactive with respect to both the high-temperature heating medium X and low-temperature heating medium Y, and having a high heat transferring performance can be preferably used as the intermediate heating medium Z. When the high-temperature heating medium X and the low-temperature heating medium Y are sodium and water, respectively, an intermediate heating medium Z such as, for example, liquid lead or liquid bismuth and the like can be used. Since the intermediate heating medium Z having a high heat transferring performance is selected, and this intermediate heating medium is circulated in a fluidized state in the cylindrical partition tubes 6, the heat can be transmitted efficiently from the high-temperature heating medium X to the low-temperature heating medium Y via the intermediate heating medium Z.

Figure 4:
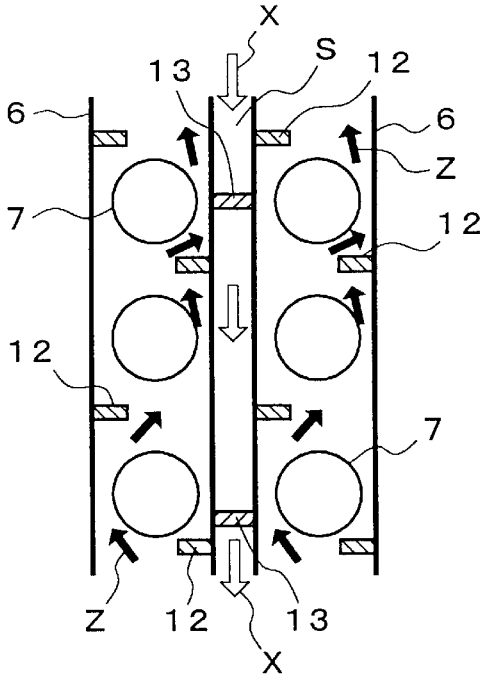
FIG. 4 is a partial enlarged view in longitudinal section showing an embodiment of the helical type heat exchanger according to the present invention.

FIG. 4 shows an embodiment preferable for further improving the heat transferring performance of the heating media in the tube bundles 21. Namely, a plurality of baffle plates 12 are provided so as to inwardly project from the opposed inner surfaces of each cylindrical partition tube 6, and these baffle plates 12 project alternately above and below the helical coil-shaped heat exchanger tube 7. Owing to such baffle plates 12, the intermediate heating medium Z flowing in the cylindrical partition tubes 6 can be made to flow in a zigzag pattern. Therefore, the heat exchange between the high-temperature heating medium X in the exterior of the cylindrical partition tubes 6 and the low-temperature heating medium Y in the interior of the heat exchanger tubes 7 is carried out more effectively via the intermediate heating medium Z, and the heat transferring performance of the heating media can be improved.

In the embodiment shown in FIG. 4, spiral spacers 13 are disposed in the clearances S between the concentrically arranged multiple cylindrical partition tubes 6. These spiral spacers 13 are similar to the spacer wires used to secure a clearance between fuel pins in a fast reactor, and have the same function as the latter. Namely, owing to the spiral spacers 13, flow passages (i.e. clearances S) for the high-temperature heating medium X between the multiple cylindrical partition tubes 6 can be secured. As a result, the heat exchange between the high-temperature heating medium X in the exterior of the cylindrical partition tubes 6 and the intermediate heating medium Z in the interior of the cylindrical partition tubes 6 is carried out effectively, so that the heat transferring performance of the heating media can be improved.

The helical type heat exchanger according to the present invention is constructed so that the high-temperature heating medium X flowing in the clearances S among the multiple cylindrical partition tubes 6 is not mixed with each other. Therefore, when the number of turns of the helical coil-shaped heat exchanger tube 7 having a larger diameter disposed in the cylindrical partition tube 6 positioned in the outer circumferential side of the concentrically arranged multiple cylindrical partition tubes is equal to the number of turns of the helical coil-shaped heat exchanger tube 7 having a smaller diameter disposed in the cylindrical partition tube 6 positioned in the inner circumferential side, a flow rate of the low-temperature heating medium Y in the heat exchanger tube 7 positioned in the outer circumferential side becomes higher than that of the same heating medium Y in the heat exchanger tube 7 positioned in the inner circumferential side. Accordingly, a temperature difference occurs between the low-temperature heating medium Y on the outer circumferential side and the same heating medium Y on the inner circumferential side. Therefore, in order to avoid the occurrence of such a difference in temperature of the low-temperature heating medium Y, it is necessary to regulate the number of turns of the helical coil-shaped heat exchanger tubes 7 on the outer and inner circumferential sides, and the flow rate of the low-temperature heating medium Y in the heat exchanger tubes 7.

Although the above description is given with sodium and water taken as examples of the high-temperature heating medium and the low-temperature heating medium, respectively, the heat exchanger according to the present invention can be utilized not only as a heat exchanger of a sodium—water system, but also widely as a heat exchanger of a system of a high-temperature heating medium and a low-temperature heating medium which are not allowed to contact each other.

As is understood from the foregoing, according to the present invention, the helical coil-shaped heat exchanger tubes are respectively disposed in the annular spaces in the concentrically arranged multiple cylindrical partition tubes. This enables the structure and manufacturing cost of the heat exchanger to be simplified and reduced, respectively, as compared with the prior art heat exchanger having a double tube structure in which one outer tube and one inner tube are paired with each other.

Moreover, since it is unnecessary that the clearance between the inner surface of the cylindrical partition tube and the helical coil-shaped heat exchanger tube disposed therein be formed as narrowly as that between the outer tube and the inner tube of the prior art double tube structure, the interior of the cylindrical partition tube can be filled with a large quantity of intermediate heating medium. Therefore, the possibility that the high-temperature heating medium (for example, sodium) in the exterior of the cylindrical partition tubes and low-temperature heating medium (for example, water) in the interior of the helical coil-shaped heat exchanger tubes contact each other can be reduced to an extremely low level even when any heat exchanger tube or cylindrical partition tube should be damaged.

Furthermore, since the intermediate heating medium having an excellent heat transferring performance is not only packed, but also circulated in a fluidized state in the interior of the cylindrical partition tubes, the heat can be transferred from the high-temperature medium to the low-temperature medium with a high efficiency via intermediate heating medium.

Furthermore, owing to the structure provided with baffle plates alternately projecting from the opposed inner surfaces of each cylindrical partition tube, and the structure provided with the spiral spacer in the clearances among the concentrically arranged multiple cylindrical partition tubes, the improvement of the heat transferring performance of the heating media can be attained.

What is claimed is:

1. A helical type heat exchanger having an intermediate heating medium, said helical type heat exchanger comprising:

a shell of said heat exchanger;

a plurality of cylindrical partition tubes each of which has an annular space therein and is closed at both end portions thereof with annular walls, said cylindrical partition tubes being arranged concentrically in a mutually spaced manner in said shell; and a plurality of helical coil-shaped heat exchanger tubes each of which is disposed in the annular space in one of said cylindrical partition tubes, wherein a high-temperature heating medium flows in said shell through clearances among said concentrically arranged cylindrical partition tubes, a low-temperature heating medium flows in each of said helical coil-shaped heat exchanger tubes, and an intermediate heating medium chemically inactive with respect to both the high-temperature heating medium and the low-temperature heating medium and excellent in heat transferring performance is passed through each of the annular spaces in said cylindrical partition tubes.

2. A helical type heat exchanger according to claim 1, wherein opposed inner surfaces of each of said cylindrical partition tubes are provided with a plurality of baffle plates so that said baffle plates on the opposed inner surfaces project alternately among said helical coil-shaped heat exchanger tubes.

3. A helical type heat exchanger according to claim 1, wherein spiral spacers are disposed in clearances among said concentrically arranged cylindrical partition tubes.

4. A helical type heat exchanger according to claim 1, wherein both end portions of each of said helical coil-shaped heat exchanger tubes are passed through said annular walls at both of the end portions of each of said cylindrical partition tubes, and extended and guided outside of said shell to form an inlet and an outlet, respectively, for the low-temperature heating medium.

5. A helical type heat exchanger according to claim 1, wherein said concentrically arranged cylindrical partition tubes are communicated with and connected to one another at a vicinity of said annular walls at both of the end portions thereof by connecting tubes, and end portions of the respective connecting tubes are guided outside of said shell to form an inlet and an outlet, respectively, for the intermediate heating medium.

6. A helical type heat exchanger according to claim 2, wherein spiral spacers are disposed in clearances among said concentrically arranged cylindrical partition tubes.

7. A helical type heat exchanger according to claim 2, wherein both end portions of each of said helical coil-shaped heat exchanger tubes are passed through said annular walls at both of the end portions of each of said cylindrical partition tubes, and extended and guided outside of said shell to form an inlet and an outlet, respectively, for the low-temperature heating medium.

8. A helical type heat exchanger according to claim 3, wherein both end portions of each of said helical coil-shaped heat exchanger tubes are passed through said annular walls at both of the end portions of each of said cylindrical partition tubes, and extended and guided outside of said shell to form an inlet and an outlet, respectively, for the low-temperature heating medium.

9. A helical type heat exchanger according to claim 2, wherein said concentrically arranged cylindrical partition tubes are communicated with and connected to one another at a vicinity of said annular walls at both of the end portions thereof by connecting tubes, and end portions of the respective connecting tubes are guided outside of said shell to form an inlet and an outlet, respectively, for the intermediate heating medium.

10. A helical type heat exchanger according to claim 3, wherein said concentrically arranged cylindrical partition tubes are communicated with and connected to one another at a vicinity of said annular walls at both of the end portions thereof by connecting tubes, and end portions of the respective connecting tubes are guided outside of said shell to form an inlet and an outlet, respectively, for the intermediate heating medium.

11. A helical type heat exchanger according to claim 4, wherein said concentrically arranged cylindrical partition tubes are communicated with and connected to one another at a vicinity of said annular walls at both of the end portions thereof by connecting tubes, and end portions of the respective connecting tubes are guided to the outside of said shell to form an inlet and an outlet, respectively, for the intermediate heating medium.

* * * * *